US011257434B2

(12) United States Patent
Xu et al.

(10) Patent No.: US 11,257,434 B2
(45) Date of Patent: Feb. 22, 2022

(54) METHOD AND DEVICE FOR COMPENSATING A DISPLAY DEVICE AND DISPLAY APPARATUS

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Haixia Xu, Beijing (CN); Zhongyuan Wu, Beijing (CN); Zhidong Yuan, Beijing (CN); Song Meng, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/768,638

(22) PCT Filed: Dec. 11, 2019

(86) PCT No.: PCT/CN2019/124501
§ 371 (c)(1),
(2) Date: May 29, 2020

(87) PCT Pub. No.: WO2020/119712
PCT Pub. Date: Jun. 18, 2020

(65) Prior Publication Data

US 2020/0312246 A1 Oct. 1, 2020

(30) Foreign Application Priority Data

Dec. 14, 2018 (CN) ..... 201811532396.9

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/006* (2013.01); *G09G 3/3291* (2013.01); *G09G 2320/041* (2013.01); *G09G 2330/12* (2013.01)

(58) Field of Classification Search
CPC .... G09G 3/3258; G09G 3/006; G09G 3/3291; G09G 2320/041; G09G 2330/12; G09G 3/3233; G09G 2320/0295; G09G 2320/045
See application file for complete search history.

(56) References Cited

U.S. PATENT DOCUMENTS 9,099,041 B2 * 8/2015 Iida ..... G09G 3/3283
2007/0115224 A1 * 5/2007 Yamamoto ..... G09G 3/3233 345/76

(Continued)

FOREIGN PATENT DOCUMENTS

CN 103886833 A 6/2014
CN 104700772 A 6/2015

(Continued)

OTHER PUBLICATIONS

ISA China National Intellectual Property Administration, International Search Report Issued in Application No. PCT/CN2019/124501, dated Mar. 11, 2020, WIPO, 15 pages. (Submitted with Partial Translation).

(Continued)

*Primary Examiner* — Jose R Soto Lopez
(74) *Attorney, Agent, or Firm* — McCoy Russell LLP

(57) ABSTRACT

A method and a device for compensating a display device and a display apparatus are provided, each pixel unit (Continued)

includes a pixel driving circuit and a light-emitting element, the pixel driving circuit includes a driving transistor and sensing line, the method includes: acquiring a first mobility and a first threshold voltage of the driving transistor, the first mobility and the first threshold voltage are acquired when the display device is not displaying; acquiring a second mobility of the driving transistor according to the electrical signal on the sensing line, the second mobility is acquired when the display device is displaying; determining a second threshold voltage of the driving transistor according to the first threshold voltage, a difference between the second mobility and the first mobility, and a compensation factor; and calculating an external compensation value of a display data signal according to the second threshold voltage and the second mobility.

13 Claims, 4 Drawing Sheets

(51) Int. Cl.
*G09G 3/00* (2006.01)
*G09G 3/3291* (2016.01)

(56) References Cited

U.S. PATENT DOCUMENTS

2007/0164959 A1* 7/2007 Childs ..... G09G 3/3291 345/92
2008/0030495 A1* 2/2008 Shirasaki ..... G09G 3/3233 345/214
2008/0106500 A1* 5/2008 Wacyk ..... G09G 3/3258 345/76
2009/0058771 A1* 3/2009 Toyomura ..... G09G 3/3233 345/80
2009/0121974 A1* 5/2009 Yamashita ..... G09G 3/3233 345/55
2009/0219231 A1* 9/2009 Yamamoto ..... G09G 3/3233 345/76
2010/0141626 A1* 6/2010 Tomida ..... G09G 3/3233 345/211
2010/0149075 A1* 6/2010 Iida ..... H01L 27/3248 345/45
2011/0063283 A1* 3/2011 Ryu ..... G09G 3/3283 345/214
2011/0096105 A1* 4/2011 Park ..... G09G 3/36 345/690
2011/0109664 A1* 5/2011 Toyomura ..... G09G 3/3225 345/690
2012/0327058 A1* 12/2012 Minami ..... G09G 3/3225 345/211
2013/0050292 A1* 2/2013 Mizukoshi ..... G09G 3/3291 345/690
2014/0176625 A1* 6/2014 Yoon ..... G09G 3/3233 345/691
2015/0077441 A1* 3/2015 Toyomura ..... G09G 3/3233 345/690
2015/0123953 A1* 5/2015 Shim ..... G09G 3/3233 345/205
2015/0154908 A1* 6/2015 Nam ..... G09G 3/3233 345/76
2015/0379937 A1* 12/2015 Kim ..... G09G 3/3291 345/691
2016/0042690 A1* 2/2016 Chang ..... G09G 3/3233 345/212
2016/0098954 A1* 4/2016 Bae ..... G09G 3/3225 345/77
2016/0300528 A1* 10/2016 Kong ..... H01L 27/3265
2017/0025061 A1* 1/2017 Takizawa ..... G09G 3/3291
2018/0053462 A1* 2/2018 Bae ..... G09G 3/3233
2018/0083078 A1* 3/2018 Park ..... H01L 51/102
2018/0268760 A1* 9/2018 Chen ..... G09G 3/3258
2020/0082759 A1* 3/2020 Lee ..... G09G 3/3291
2020/0082767 A1* 3/2020 Chen ..... G09G 3/3233
2020/0118488 A1* 4/2020 Kim ..... G09G 3/3291
2020/0143751 A1* 5/2020 Byun ..... G09G 3/3291
2020/0152123 A1* 5/2020 Kim ..... G09G 3/3233
2020/0193912 A1* 6/2020 Park ..... G09G 3/3275
2020/0234644 A1* 7/2020 Li ..... G09G 3/3258

FOREIGN PATENT DOCUMENTS

CN 105489167 A 4/2016
CN 106165007 A 11/2016
CN 10678233 A 5/2017
CN 106856086 A 6/2017
CN 106991965 A 7/2017
CN 106991969 A * 7/2017 ..... G09G 3/3291
CN 106991969 A 7/2017
CN 107731160 A 2/2018
CN 108877686 A 11/2018
CN 109727578 A 5/2019
KR 20150079090 A 7/2015
KR 20170118436 A 10/2017

OTHER PUBLICATIONS

State Intellectual Property Office of the People's Republic of China, Office Action and Search Report Issued in Application No. 201811532396.9, dated Apr. 1, 2020, 18 pages. (Submitted with Partial Translation).

* cited by examiner

METHOD AND DEVICE FOR COMPENSATING A DISPLAY DEVICE AND DISPLAY APPARATUS

CROSS-REFERENCE TO RELATED APPLICATIONS

This application is the U.S. national phase of PCT Application No. PCT/CN2019/124501 filed on Dec. 11, 2019, which claims priority to Chinese Patent Application No. 201811532396.9 filed in China on Dec. 14, 2018. The entire contents of each of the above-listed applications are hereby incorporated by reference for all purposes.

TECHNICAL FIELD

The present disclosure relates to the field of display technologies, in particular to a method and a device for compensating a display device and a display apparatus.

BACKGROUND AND SUMMARY

An Active matrix organic light emitting diode (AMOLED) display panel, as a current-type light-emitting device, has been increasingly used in a high-performance display. Due to a self-luminous characteristic, compared with a liquid crystal display (LCD), the AMOLED has many advantages such as wide color gamut, high contrast, ultra-light and thin.

Technical solutions are provided as follows in some embodiments of the present disclosure.

In one aspect, a method for compensating a display device is provided, the display device includes a plurality of rows of pixel units, at least one of the plurality of rows of pixel units includes a pixel driving circuit and a light-emitting element coupled to the pixel driving circuit, the pixel driving circuit includes a driving transistor and a sensing line for sensing an electrical signal of the light-emitting element, the method for compensating the display device includes:

acquiring a first mobility and a first threshold voltage of the driving transistor, the first mobility and the first threshold voltage are acquired when the display device is not displaying;

acquiring a second mobility of the driving transistor according to the electrical signal on the sensing line, the second mobility is acquired when the display device is displaying;

determining a second threshold voltage of the driving transistor according to the first threshold voltage, a difference between the second mobility and the first mobility, and a pre-acquired compensation factor; and calculating an external compensation value of a display data signal according to the second threshold voltage and the second mobility, superimposing the external compensation value and the display data signal, and inputting a superimposed display data signal to the pixel driving circuit for driving the light-emitting element to emit light.

Further, the acquiring the second mobility of the driving transistor according to the electrical signal on the sensing line includes:

inputting an adjustment voltage to a data line of the pixel driving circuit, the adjustment voltage is a sum of a reference voltage and the first threshold voltage of the driving transistor, the reference voltage is a fixed value; and calculating the second mobility according to the electrical signal on the sensing line of the pixel driving circuit.

Further, prior to the determining the second threshold voltage of the driving transistor according to the first threshold voltage, the difference between the second mobility and the first mobility, and the pre-acquired compensation factor, the method further includes a step of acquiring the compensation factor, and the step of acquiring the compensation factor includes:

acquiring a first curve of the mobility of the driving transistor with temperature, and calculating a mobility temperature change slope of the driving transistor according to the first curve;

acquiring a second curve of the threshold voltage of the driving transistor with temperature, and calculating a threshold voltage temperature change slope of the driving transistor according to the second curve; and acquiring the compensation factor a according to the mobility temperature change slope and the threshold voltage temperature change slope.

Further, the acquiring the compensation factor a according to the mobility temperature change slope and the threshold voltage temperature change slope includes:

determining the compensation factor a according to the following formula:

$$a = \text{the threshold voltage temperature change slope/the mobility temperature change slope.}$$

Further, the determining the second threshold voltage of the driving transistor according to the first threshold voltage, the difference between the second mobility and the first mobility, and the pre-acquired compensation factor includes:

determining the second threshold voltage of the driving transistor according to the following formula:

$$\text{the second threshold voltage} = \text{the first threshold voltage} + a^*(\text{the second mobility} - \text{the first mobility})$$

a is the compensation factor.

Further, the external compensation value is determined according to a second threshold voltage and a second mobility of a driving transistor in a pixel unit of a (n−1)th row, $$\text{the external compensation value} = \text{the second threshold voltage} - \text{the first threshold voltage} = a^*(\text{the second mobility} - \text{the first mobility}) = a^*(K'(n-1) - K(n-1)) = a^*\Delta K(n-1)$$

ΔK (n−1) is a difference between the second mobility K'(n−1) and the first mobility K(n−1) of the driving transistor in the pixel unit of the (n−1)th row, n is an integer larger than 1, a is the compensation factor;

the superimposed display data signal is an adjustment voltage on a data line of a pixel driving circuit in a pixel unit of the nth row, and the superimposing the external compensation value and the original display data signal includes:

determining the adjustment voltage on the data line of the pixel driving circuit in the pixel unit of the nth row according to the following formula:

$$\text{the adjustment voltage} = \text{a reference voltage} + \text{the first threshold voltage} + \text{the external compensation value}$$

the reference voltage is a fixed value.

A device for compensating a display device is further provided in some embodiments of the present disclosure, the display device includes a plurality of rows of pixel units, at least one of the plurality of rows of pixel units includes a pixel driving circuit and a light-emitting element coupled to the pixel driving circuit, the pixel driving circuit includes a driving transistor and a sensing line for sensing an electrical signal of the light-emitting element, the device for compensating the display device includes:

a measurement sub-circuit, configured to acquire a first mobility and a first threshold voltage of the driving transistor, the first mobility and the first threshold voltage are acquired when the display device is not displaying;

an acquisition sub-circuit, configured to acquire a second mobility of the driving transistor according to the electrical signal on the sensing line, the second mobility is acquired when the display device is displaying;

a processing sub-circuit, configured to determine a second threshold voltage of the driving transistor according to the first threshold voltage, a difference between the second mobility and the first mobility, and a pre-acquired compensation factor; and a compensation sub-circuit, configured to calculate an external compensation value of a display data signal according to the second threshold voltage and the second mobility, superimpose the external compensation value and the display data signal, and input a superimposed display data signal to the pixel driving circuit for driving the light-emitting element to emit light.

Further, the acquisition sub-circuit is further configured to:

input an adjustment voltage to a data line of the pixel driving circuit, the adjustment voltage is a sum of a reference voltage and the first threshold voltage of the driving transistor, the reference voltage is a fixed value; and calculate the second mobility according to the electrical signal on the sensing line of the pixel driving circuit.

Further, the device for compensating the display device further includes a compensation factor acquisition sub-circuit, the compensation factor acquisition sub-circuit includes:

a first curve acquisition unit, configured to acquire a first curve of the mobility of the driving transistor with temperature, and calculate a mobility temperature change slope of the driving transistor according to the first curve;

a second curve acquisition unit, configured to acquire a second curve of the threshold voltage of the driving transistor with temperature, and calculate a threshold voltage temperature change slope of the driving transistor according to the second curve; and a calculation unit, configured to acquire the compensation factor a according to the mobility temperature change slope and the threshold voltage temperature change slope.

Further, the calculation unit is further configured to determine the compensation factor a according to the following formula:

$$a = \text{the threshold voltage temperature change slope} / \text{the mobility temperature change slope.}$$

Further, the processing sub-circuit is further configured to determine the second threshold voltage of the driving transistor according to the following formula:

$$\text{the second threshold voltage} = \text{the first threshold voltage} + a^*(\text{the second mobility} - \text{the first mobility})$$

a is the compensation factor.

Further, the compensation sub-circuit is further configured to calculate an external compensation value of a display data signal of a pixel driving circuit in a pixel unit of an nth row according to a second threshold voltage and a second mobility of a driving transistor in a pixel unit of a (n−1)th row, $$\text{the external compensation value} = \text{the second threshold voltage} - \text{the first threshold voltage} = a^*(\text{the second mobility} - \text{the first mobility}) = a^*(K'(n-1) - K(n-1)) = a^*\Delta K(n-1)$$

ΔK (n−1) is a difference between the second mobility K'(n−1) and the first mobility K(n−1) of the driving transistor in the pixel unit of the (n−1)th row, n is an integer larger than 1, a is the compensation factor;

the superimposed display data signal is an adjustment voltage on a data line of a pixel driving circuit in a pixel unit of the nth row, and the compensation sub-circuit is further configured to determine the adjustment voltage on the data line of the pixel driving circuit in the pixel unit of the nth row according to the following formula:

$$\text{the adjustment voltage} = \text{a reference voltage} + \text{the first threshold voltage} + \text{the external compensation value,}$$

wherein, the reference voltage is a fixed value.

A display apparatus is further provided in some embodiments of the present disclosure, including the device for compensating the display device described above.

A device for compensating the display device is further provided in some embodiments of the present disclosure, including: a memory, a processor, and a computer program stored in the memory and executed by the processor, the processor is configured to execute the computer program to perform the method for compensating the display device described above.

A computer readable medium on which a computer program is stored is further provided in some embodiments of the present disclosure, the computer program is executed by a processor to perform the method for compensating the display device described above.

DETAILED DESCRIPTION

In order to make a technical problem to be solved, a technical solution and an advantage of the embodiments of the present disclosure clearer, a detail description will be given below with reference to the accompanying drawings and the specific embodiments.

In the related art, a driving transistor of an OLED pixel is usually made of semiconductor materials such as amorphous silicon, polycrystalline silicon, or metal oxide. However, electric parameters, such as a threshold voltage Vth and a mobility K, of each driving transistor of the OLED pixel often fluctuate due to a manufacturing process, which may be converted into a current difference and a brightness difference of an OLED display device, and is perceived by human eyes. And the threshold voltage of the driving transistor also drifts during usage of the OLED, and threshold drifts of the driving transistors of each part of the OLED pixel are different since that display images are different in different positions of the OLED pixel, which may cause a difference in display brightness. Since the difference is related to a previously displayed image, it often appears as an image sticking phenomenon, which is also known as image sticking.

Figure 1:
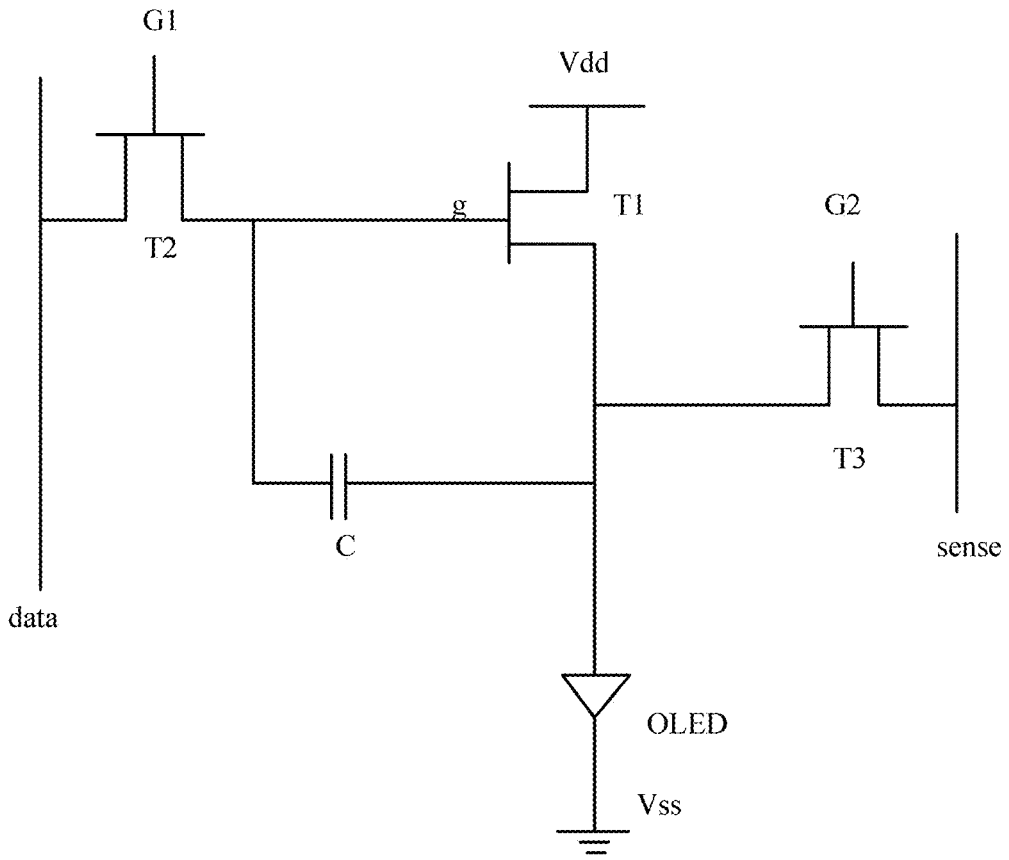
FIG. 1 is a diagram of an OLED compensation circuit.

In the related art, in order to solve the problem of image sticking, since the threshold voltage of the driving transistor is difficult to acquire during display, and only the mobility of the driving transistor is compensated. FIG. 1 is a diagram of an OLED compensation circuit. Referring to FIG. 1, the compensation circuit is electrically connected to all sub-pixels in one pixel unit simultaneously. It takes that the compensation circuit is connected to one sub-pixel as an example in FIG. 1. Referring to FIG. 1, a circuit structure in the sub-pixel includes a driving thin film transistor (TFT) T1, a control TFT T2, a capacitor C and an OLED, a gate electrode of the T2 is connected to a gate line G1, a source electrode of the T2 is electrically connected to a data line data, a drain electrode of the T2 is connected to a gate electrode (point g in FIG. 1) of the T1, and a drain electrode of the T1 is connected to a power supply Vdd, a source electrode of the T1 is connected to an anode of the OLED, a cathode of the OLED is connected to a power supply Vss, and two terminals of the capacitor C are respectively connected to the gate electrode and the source electrode of the driving TFT T1. The compensation circuit includes: a sensing line sense and at least two sensing TFT T3 (only one is shown in FIG. 1), the at least two sensing TFTs correspond to at least two sub-pixels in the pixel unit where the sensing line sense is located one to one. The sensing line sense is simultaneously connected to the driving TFTs in the at least two sub-pixels, and each sensing TFT is connected between the driving TFT in the corresponding sub-pixel and the sensing line sense. When sensing the driving transistor (such as T1) of the sub-pixel, a display time of one frame is divided into a compensation time period and a display time period, and a test electric signal is inputted to the data line data during the compensation time period, and an electrical signal outputted from the sense line sense is received, a mobility of the driving transistor is calculated according to the electrical signal outputted from the sensing line sense, the calculated mobility is fed back to the pixel driving circuit, a compensation is performed on a display data signal according to the mobility in the pixel driving circuit, the pixel driving circuit at least includes the T1, and the display data signal is a signal inputted to the OLED for driving the OLED to emit light.

However, the OLED is a current type device. When a current flows into the OLED, it will also be accompanied by a temperature. With an increase of a lighting time, the temperature of the OLED will rise, and the threshold voltage of the driving transistor is changed due to an increase of the temperature. Thus, an image sticking compensation effect is poor when only the mobility of the driving transistor is compensated.

Figure 2:
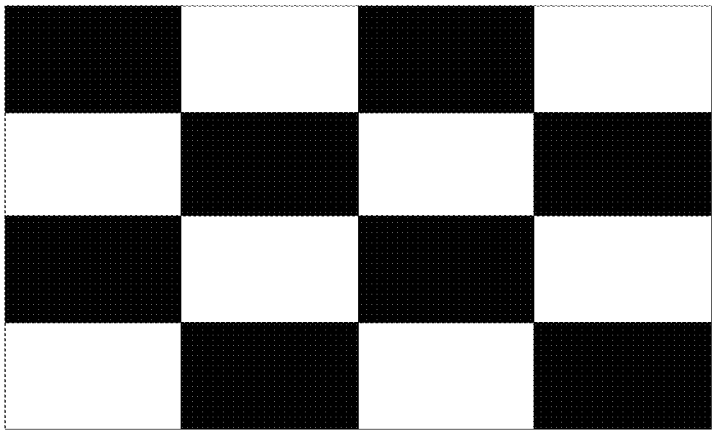
FIG. 2 is a schematic diagram of a checkerboard image.
Figure 3:
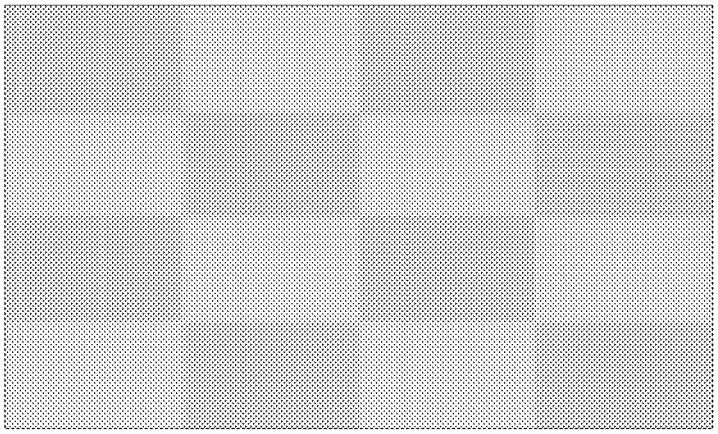
FIG. 3 is a schematic diagram after performing compensation on the checkerboard image in the related art.

FIG. 2 is a schematic diagram of a checkerboard image, FIG. 3 is a schematic diagram after performing compensation on the checkerboard image in the related art, and it can be seen that the image sticking compensation effect is poor.

In view of the above problem, a method and a device for compensating a display device and a display apparatus are provided in some embodiments of the present disclosure to improve the image sticking compensation effect.

Figure 4:
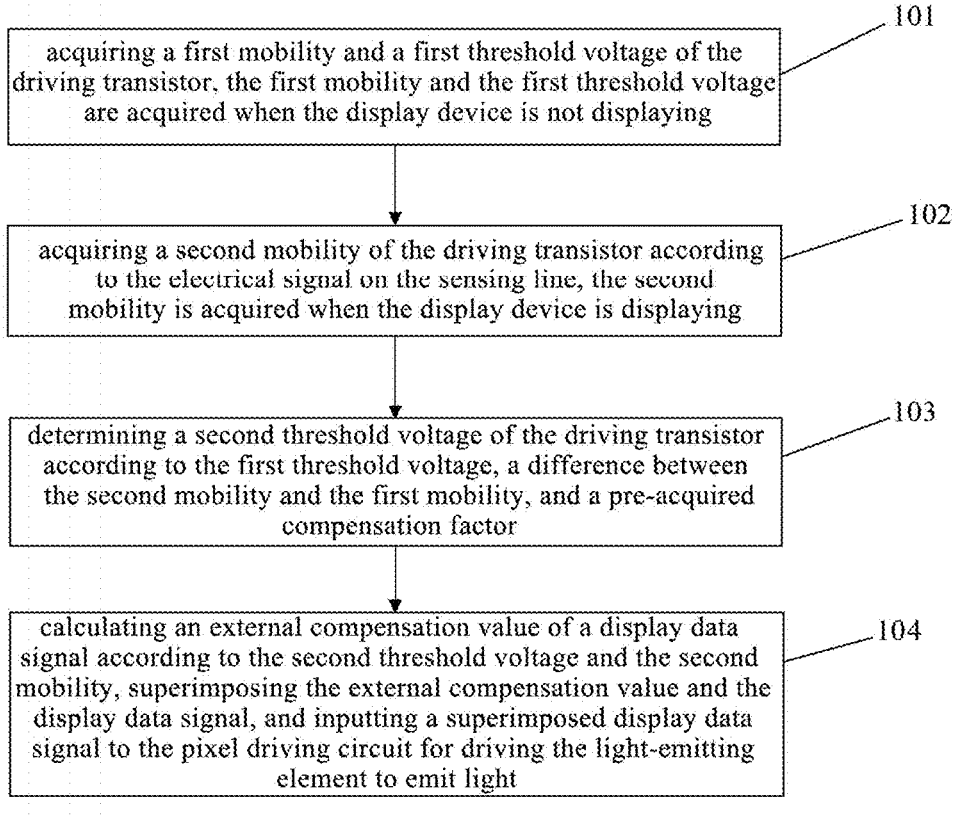
FIG. 4 is a schematic flowchart of a method for compensating a display device in some embodiments of the present disclosure.

A method for compensating a display device is provided in some embodiments of the present disclosure, the display device includes a plurality of rows of pixel units, at least one of the plurality of rows of pixel units includes a pixel driving circuit and a light-emitting element coupled to the pixel driving circuit, the pixel driving circuit includes a driving transistor and a sensing line for sensing an electrical signal of the light-emitting element, as shown in FIG. 4, the method for compensating the display device includes the following steps.

Step 101, acquiring a first mobility and a first threshold voltage of the driving transistor, the first mobility and the first threshold voltage are acquired when the display device is not displaying.

Step 102, acquiring a second mobility of the driving transistor according to the electrical signal on the sensing line, the second mobility is acquired when the display device is displaying.

Step 103, determining a second threshold voltage of the driving transistor according to the first threshold voltage, a difference between the second mobility and the first mobility, and a pre-acquired compensation factor.

Step 104, calculating an external compensation value of a display data signal according to the second threshold voltage and the second mobility, superimposing the external compensation value and the display data signal, and inputting a superimposed display data signal to the pixel driving circuit for driving the light-emitting element to emit light.

In the present embodiment, when the display device displays, the threshold voltage of the driving transistor is affected due to the increase of the temperature. And the image sticking compensation effect is affected when the display data signal is compensated only according to the mobility. In the technical solution of the present disclosure, the compensation factor is pre-acquired, after acquiring the mobility of the driving transistor during display of the display device, the threshold voltage of the driving transistor during display of the display device is determined by combining the compensation factor and the mobility of the driving transistor, the display data signal is compensated according to the acquired mobility of the driving transistor and the acquired threshold voltage of the driving transistor, which may improve the image sticking compensation effect.

In an embodiment, the acquiring the second mobility of the driving transistor according to the electrical signal on the sensing line includes: inputting an adjustment voltage to a data line of the pixel driving circuit, the adjustment voltage is a sum of a reference voltage and the first threshold voltage of the driving transistor, the reference voltage is a fixed value; and calculating and acquiring the second mobility according to the electrical signal on the sensing line of the pixel driving circuit.

The mobility K of the driving transistor may be acquired according to the following formula:

$$K = \frac{1}{b\sqrt{V_{sense}}}$$

b is a fixed value, and Vsense is a voltage value sensed on the sensing line.

The threshold voltage Vth may be acquired according to the following formula:

$$Vth = Vg - V\text{sense};$$

Vg is a voltage value at point g of the driving transistor, and Vsense is the voltage value sensed on the sensing line.

In an embodiment, prior to the determining the second threshold voltage of the driving transistor according to the first threshold voltage, the difference between the second mobility and the first mobility, and the pre-acquired compensation factor, the method further includes a step of acquiring the compensation factor, and the step of acquiring the compensation factor includes: acquiring a first curve of the mobility of the driving transistor with temperature, and calculating a mobility temperature change slope of the driving transistor according to the first curve; acquiring a second curve of the threshold voltage of the driving transistor with temperature, and calculating a threshold voltage temperature change slope of the driving transistor according to the second curve; and acquiring the compensation factor a according to the mobility temperature change slope and the threshold voltage temperature change slope.

In an embodiment, the acquiring the compensation factor a according to the mobility temperature change slope and the threshold voltage temperature change slope includes: determining the compensation factor a according to the following formula:

$a$=the threshold voltage temperature change slope/the mobility temperature change slope.

In an embodiment, the determining the second threshold voltage of the driving transistor according to the first threshold voltage, the difference between the second mobility and the first mobility, and the pre-acquired compensation factor includes: determining the second threshold voltage of the driving transistor according to the following formula:

the second threshold voltage=the first threshold voltage+$a$*(the second mobility−the first mobility), a is the compensation factor.

When compensation is performed on the display device, the sensing line is used to sense the electrical signal of the driving transistor in the pixel unit. The sensing line is connected to all the sub-pixels in one pixel unit, and the electrical signal is outputted from the sensing line. The sensing line senses only signals of driving transistors of sub-pixels of one color in pixel units of a row in a display time of each frame, and senses signals of driving transistors of sub-pixels of a same color in pixel units of a next row in a display time of a next frame. After sensing all sub-pixels of the color, the sensing line starts to sense signals of driving transistors of sub-pixels of another color from a first row. Then if there are a rows of pixel units in the display device, and there are b colors of sub-pixels in each pixel unit, after sensing signals of driving transistors of sub-pixels of a first color in pixel units of an nth row, it needs to wait a*b/m seconds to sense the signals of the driving transistors of the sub-pixels of the first color in the pixel units of the nth row again, m is a refresh rate.

When acquiring the mobility of the driving transistor during display of the display device, the reference voltage+an initial threshold voltage (i.e., the first threshold voltage) of the driving transistor is inputted to the data line to acquire the electrical signal of the sensing line, the reference voltage may be the fixed value, and then the mobility of the driving transistor is acquired during display. But when sensing the signals of the driving transistors, only the driving transistors in the pixel units of one row may be sensed at a time, a sensing speed is slow, and the threshold voltage of the driving transistor of the sub-pixel in the pixel unit changes greatly due to the increase of the temperature of the display device in a process of sensing, if the mobility of the driving transistor is determined based on the initial threshold voltage only, a large error will occur. Since temperatures of the pixel units of two adjacent rows are not much different, and are basically the same, the mobility of the driving transistors in the row may be determined by using threshold voltage change information of the driving transistors in the pixel units of a previous row, which may reduce the error.

In an embodiment, the external compensation value is determined according to a second threshold voltage and a second mobility of a driving transistor in a pixel unit of a (n−1)th row, the external compensation value=the second threshold voltage−the first threshold voltage=$a$*(the second mobility−the first mobility)=$a$*($K'(n-1)-K(n-1)$)=$a$*$\Delta K(n-1)$, wherein, ΔK(n−1) is a difference between the second mobility K' (n−1) and the first mobility K(n−1) of the driving transistor in the pixel unit of the (n−1)th row, n is an integer larger than 1, a is the compensation factor;

the superimposed display data signal is an adjustment voltage on a data line of a pixel driving circuit in a pixel unit of an nth row, and the superimposing the external compensation value and the original display data signal includes:

determining the adjustment voltage on the data line of the pixel driving circuit in the pixel unit of the nth row according to the following formula:

the adjustment voltage=a reference voltage+the first threshold voltage+the external compensation value, wherein, the reference voltage is a fixed value.

Figure 5:
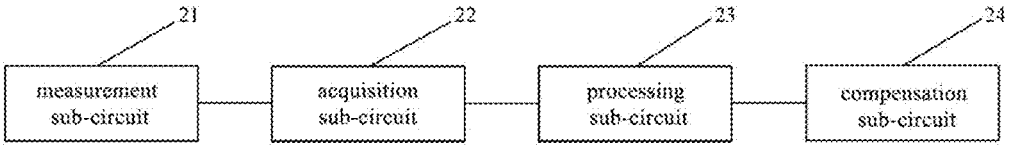
FIG. 5 is a structural block diagram of a device for compensating a display device in some embodiments of the present disclosure.

A device for compensating a display device is further provided in some embodiments of the present disclosure, the display device includes a plurality of rows of pixel units, at least one of the plurality of rows of pixel units includes a pixel driving circuit and a light-emitting element coupled to the pixel driving circuit, the pixel driving circuit includes a driving transistor and a sensing line for sensing an electrical signal of the light-emitting element, as shown in FIG. 5, the device for compensating the display device includes a measurement sub-circuit 21, an acquisition sub-circuit 22, a processing sub-circuit 23 and a compensation sub-circuit 24.

The measurement sub-circuit 21 is configured to acquire a first mobility and a first threshold voltage of the driving transistor, the first mobility and the first threshold voltage are acquired when the display device is not displaying.

The acquisition sub-circuit 22 is configured to acquire a second mobility of the driving transistor according to the electrical signal on the sensing line, the second mobility is acquired when the display device is displaying.

The processing sub-circuit 23 is configured to determine a second threshold voltage of the driving transistor according to the first threshold voltage, a difference between the second mobility and the first mobility, and a pre-acquired compensation factor.

The compensation sub-circuit 24 is configured to calculate an external compensation value of a display data signal according to the second threshold voltage and the second mobility, superimpose the external compensation value and the display data signal, and input a superimposed display data signal to the pixel driving circuit for driving the light-emitting element to emit light.

Functions of the measurement sub-circuit 21 and the acquisition sub-circuit 22 may be realized by the OLED compensation circuit shown in FIG. 1, a function of the processing sub-circuit 23 may be realized by a processor having a calculation function, and a function of the compensation sub-circuit 24 may be realized by using the pixel driving circuit.

In the present embodiment, when the display device displays, the threshold voltage of the driving transistor is affected due to the increase of the temperature. And the image sticking compensation effect is affected when the display data signal is compensated only according to the mobility. In the technical solution of the present disclosure, the compensation factor is pre-acquired, after acquiring the mobility of the driving transistor during display of the display device, the threshold voltage of the driving transistor during display of the display device is determined by combining the compensation factor and the mobility of the driving transistor, the display data signal is compensated according to the acquired mobility of the driving transistor and the acquired threshold voltage of the driving transistor, which may improve the image sticking compensation effect.

In an embodiment, the acquisition sub-circuit is further configured to: input an adjustment voltage to a data line of the pixel driving circuit, the adjustment voltage is a sum of a reference voltage and the first threshold voltage of the driving transistor, the reference voltage is a fixed value; and calculate the second mobility according to the electrical signal on the sensing line of the pixel driving circuit.

The mobility K of the driving transistor may be acquired according to the following formula:

$$K = \frac{1}{b\sqrt{V_{sense}}}$$

b is a fixed value, and Vsense is a voltage value sensed on The sensing line.

The threshold voltage Vth may be acquired according to the following formula:

$$Vth = Vg - V\text{sense}$$

Vg is a voltage value at point g of the driving transistor, and Vsense is the voltage value sensed on the sensing line.

In an embodiment, the device for compensating the display device further includes a compensation factor acquisition sub-circuit, the compensation factor acquisition sub-circuit includes: a first curve acquisition unit, configured to acquire a first curve of the mobility of the driving transistor with temperature, and calculate a mobility temperature change slope of the driving transistor according to the first curve; a second curve acquisition unit, configured to acquire a second curve of the threshold voltage of the driving transistor with temperature, and calculate a threshold voltage temperature change slope of the driving transistor according to the second curve; and a calculation unit, configured to acquire the compensation factor a according to the mobility temperature change slope and the threshold voltage temperature change slope.

In an embodiment, the calculation unit is further configured to determine the compensation factor a according to the following formula:

$a$=the threshold voltage temperature change slope/the mobility temperature change slope.

In an embodiment, the processing sub-circuit is further configured to determine the second threshold voltage of the driving transistor according to the following formula:

the second threshold voltage=the first threshold voltage+$a$*(the second mobility−the first mobility).

When compensation is performed on the display device, the sensing line is used to sense the electrical signal of the driving transistor in the pixel unit. The sensing line is connected to all the sub-pixels in one pixel unit, and the electrical signal is outputted from the sensing line. The sensing line senses only signals of driving transistors of sub-pixels of one color in pixel units of a row in a display time of each frame, and senses signals of driving transistors of sub-pixels of a same color in pixel units of a next row in a display time of a next frame. After sensing all sub-pixels of the color, the sensing line starts to sense signals of driving transistors of sub-pixels of another color from a first row. Then if there are a rows of pixel units in the display device, and there are b colors of sub-pixels in each pixel unit, after sensing signals of driving transistors of sub-pixels of a first color in pixel units of an nth row, it needs to wait a*b/m seconds to sense the signals of the driving transistors of the sub-pixels of the first color in the pixel units of the nth row again, m is a refresh rate.

When acquiring the mobility of the driving transistor during display of the display device, the reference voltage+an initial threshold voltage (i.e., the first threshold voltage) of the driving transistor is inputted to the data line to acquire the electrical signal of the sensing line, the reference voltage may be the fixed value, and then the mobility of the driving transistor is acquired during display. But when sensing the signals of the driving transistors, only the driving transistors in the pixel units of one row may be sensed at a time, a sensing speed is slow, and the threshold voltage of the driving transistor of the sub-pixel in the pixel unit changes greatly due to the increase of the temperature of the display device in a process of sensing, if the mobility of the driving transistor is determined based on the initial threshold voltage only, a large error will occur. Since temperatures of the pixel units of two adjacent rows are not much different, and are basically the same, the mobility of the driving transistors in the row may be determined by using threshold voltage change information of the driving transistors in the pixel units of a previous row, which may reduce the error.

In a specific embodiment, the compensation sub-circuit is further configured to calculate an external compensation value of a display data signal of a pixel driving circuit in a pixel unit of an nth row according to a second threshold voltage and a second mobility of a driving transistor in a pixel unit of a (n−1)th row, the external compensation value=the second threshold voltage−the first threshold voltage=$a$*(the second mobility−the first mobility)=$a$*($K'(n-1)-K(n-1)$)=$a*\Delta K(n-1)$ ΔK (n−1) is a difference between the second mobility K' (n−1) and the first mobility K(n−1) of the driving transistor in the pixel unit of the (n−1)th row, n is an integer larger than 1, a is the compensation factor;

the superimposed display data signal is an adjustment voltage on a data line of a pixel driving circuit in a pixel unit of the nth row, and the compensation sub-circuit is further configured to determine the adjustment voltage on the data line of the pixel driving circuit in the pixel unit of the nth row according to the following formula:

the adjustment voltage=a reference voltage+the first threshold voltage+the external compensation value, wherein the reference voltage is a fixed value.

The technical solutions of the present disclosure will be further introduced below with reference to the drawings and specific embodiments.

In the embodiment, the first curve of the mobility of the driving transistor with temperature and the second curve of the threshold voltage of the driving transistor with temperature are first established.

Figure 6:
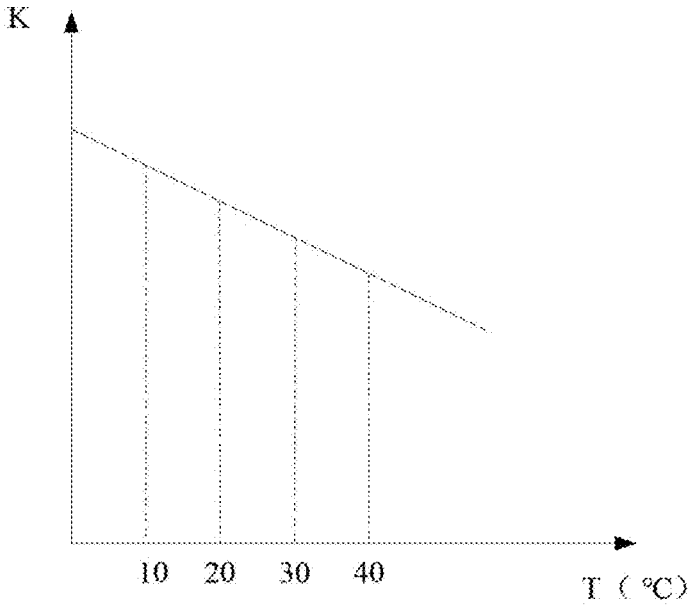
FIG. 6 is a schematic diagram of a first curve established in some embodiments of the present disclosure.

When establishing the first curve, an ambient temperature of the display device may be adjusted to a preset temperature, K (i.e., mobility) of all the driving transistors may be measured, and an average value of K of all the driving transistors may be calculated and acquired, then a set of test data including the average value of K and the preset temperature is acquired, and so on, multiple sets of test data are acquired to establish the first curve shown in FIG. 6. Any continuous line is referred to as a curve, including a straight line, a polyline, a line segment, an arc, etc.

Figure 7:
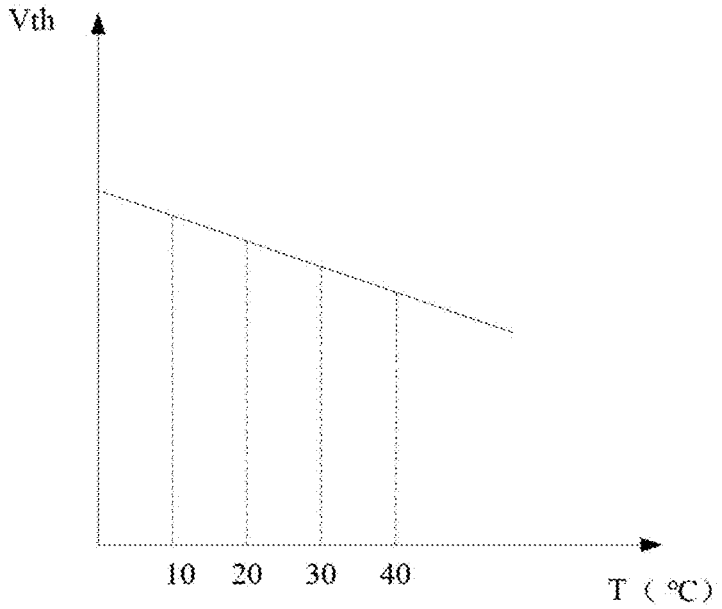
FIG. 7 is a schematic diagram of a second curve established in some embodiments of the present disclosure.

When establishing the second curve, the ambient temperature of the display device may be adjusted to the preset temperature, Vth (i.e., threshold voltages) of all the driving transistors may be measured, and an average value of Vth of all the driving transistors may be calculated and acquired, then a set of test data including the average value of Vth and the preset temperature is acquired, and so on, multiple sets of test data are acquired to establish the second curve shown in FIG. 7. Any continuous line is referred to as a curve, including a straight line, a polyline, a line segment, an arc, etc.

The mobility K of the driving transistor may be acquired according to the following formula:

$$K = \frac{1}{b\sqrt{V_{sense}}}$$

b is a fixed value, and Vsense is a voltage value sensed on the sensing line.

The threshold voltage Vth may be acquired according to the following formula:

$$Vth = Vg - V\text{sense}$$

Vg is a voltage value at point g of the driving transistor, and Vsense is the voltage value sensed on the sensing line.

After the first curve and the second curve are acquired, a slope K' of the first curve and a slope Vth' of the second curve may be calculated, so as to calculate a=Vth'/K'.

When the display device is not displaying, the mobility and threshold voltages of all the driving transistors are measured as initial mobility K (i.e., the first mobility) and the initial threshold voltages Vth (i.e., the first threshold voltages) of the driving transistors.

When the display device is displaying, in the compensation time period of the display time of each frame, the electrical signal is inputted to the data line, and an actual mobility (i.e., the second mobility) of the driving transistor is calculated and acquired according to the electrical signal outputted from the sensing line.

The second threshold voltage of the driving transistor is calculated and acquired according to the difference between the second mobility and the first mobility and a, i.e., the second threshold voltage=the first threshold voltage+a*(the second mobility−the first mobility).

Figure 8:
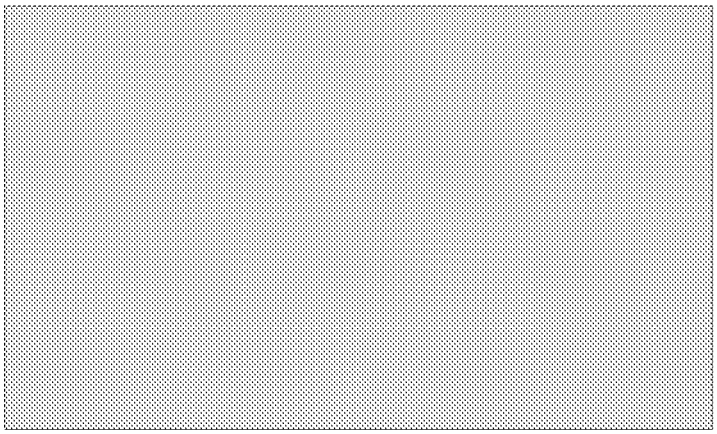
FIG. 8 is a schematic diagram after performing compensation on the checkerboard image in some embodiments of the present disclosure.

Then, the second mobility and the second threshold voltage of the driving transistor are inputted to the pixel driving circuit, and an external compensation value of a display data signal of a next row is calculated according to the second mobility and the second threshold voltage of the driving transistor in the pixel driving circuit to compensate the display data signal of the next row. FIG. 8 is a schematic diagram after performing the compensation on the checkerboard image in the embodiments, it can be seen that the image sticking compensation effect is improved.

When the compensation is performed on the display device, the sensing line is used to sense the electrical signal of the driving transistor in the pixel unit. The sensing line is connected to all the sub-pixels in one pixel unit, and the electrical signal is outputted from the sensing line. The sensing line senses only signals of driving transistors of sub-pixels of one color in pixel units of the row in the display time of each frame, and senses signals of driving transistors of sub-pixels of the same color in pixel units of the next row in the display time of the next frame. After sensing all the sub-pixels of the color, the sensing line starts to sense signals of driving transistors of sub-pixels of another color from the first row. Then if there are 2160 rows of pixel units in the display device, and there are 4 colors of sub-pixels in each pixel unit, after sensing the signals of the driving transistors of the sub-pixels of the first color in the pixel units of the nth row, it needs to wait 144 seconds to sense the signals of the driving transistors of the sub-pixels of the first color in the pixel units of the nth row again, which is taking that the refresh rate is 60 Hz as an example. After such a long time, the threshold voltage of the driving transistor of the sub-pixel in the pixel unit changes greatly due to the increase of the temperature of the display device, if the initial threshold voltage is still used for sensing, a large error will occur. Since the temperatures of the pixel units of two adjacent rows are not much different, and are basically the same, when sensing the pixel units of each row, the mobility of the driving transistors in the row may be determined by using threshold voltage change information of the driving transistors in the pixel units of the previous row, which may reduce the error.

Specifically, when a compensation is performed on driving transistors in pixel units of a first row, taking a specific driving transistor as an example, ΔK1=K1'−K1 is acquired by comparing a sensed second mobility K1' of the driving transistor and an initial first mobility K1, thereby calculating a difference ΔVth1=a*ΔK1 between a second threshold voltage and a first threshold voltage of the specific driving transistor.

When a compensation is performed on driving transistors in pixel units of a second row, Vref (reference voltage)+Vth2+ΔVth1 is inputted to the data line, Vth2 is a first threshold voltage of a driving transistor in a same column with the specific driving transistor and in the second row, and a second mobility K2' of the driving transistor is acquired according to an electrical signal outputted from the sensing line, ΔK2=K2'−K2 is acquired by comparing the K2' and an initial first mobility K2, thereby calculating a difference ΔVth2=a*ΔK2 between a second threshold voltage and a first threshold voltage of the driving transistor.

When a compensation is performed on driving transistors in pixel units of a third row, Vref (reference voltage)+Vth3+ΔVth2 is inputted to the data line, Vth3 is a first threshold voltage of a driving transistor in a same column with the specific driving transistor and in the third row, and a second mobility K3' of the driving transistor is acquired according to an electrical signal output from the sensing line, ΔK3=K3'−K3 is acquired by comparing the K3' and an initial first mobility K3, thereby calculating a difference ΔVth3=a*ΔK3 between a second threshold voltage and a first threshold voltage of the driving transistor.

Likewise, when a compensation is performed on driving transistors in pixel units of an nth row, Vref (reference voltage)+Vthn+ΔVth(n−1) is inputted to the data line, i.e., an adjustment voltage $V_n$ on the data line of the pixel driving circuit in the pixel units of the nth row is $V_n$=Vref+Vthn+ΔVth(n−1)=Vref+Vthn+a*ΔK(n−1). Vthn is a first threshold voltage of a driving transistor in a same column with the specific driving transistor and in the nth row, ΔVth(n−1) is a difference between a second threshold voltage Vth'(n−1) and a first threshold voltage Vth(n−1) of a driving transistor in a (n−1)th row, a is the compensation factor, ΔK(n−1) is a difference between a second mobility K'(n−1) and a first mobility K(n−1) of the driving transistor in the (n−1)th row.

After acquiring the adjustment voltage $V_n$ on the data line of the pixel driving circuit in the pixel unit of the nth row, a driving voltage $V_{gs}$ of the driving transistor may be acquired. For the driving transistor in the pixel unit of the nth row which is in the same column with the specific driving transistor and in the nth row, a light-emitting current I of a light-emitting element corresponding to the driving transistor may be acquired according to the following formula:

$$I = \frac{1}{2} KnC_{ox} \frac{W}{L} (V_{gs} - V_{thn})^2$$

$C_{ox}$ is a gate oxide capacitance of the driving thin film transistor TFT, and is a fixed value; W/L is a width-to-length ratio of the driving thin-film transistor TFT, and is a fixed value determined by a transistor structure; $V_{gs}$ is a driving voltage of the driving thin film transistor; $K_n$ is an initial mobility of the driving thin film transistor TFT in the pixel unit of the nth row, and $V_{thn}$ is an initial threshold voltage of the driving TFT in the pixel unit of the nth row.

Further, compensation may be performed on the driving transistor. For example, by inputting the adjustment voltage $V_n$ to the data line of the pixel driving circuit in the pixel unit of the nth row, a sensing voltage $V_{sense}$ on the sensing line may be acquired, and a compensated second mobility Kn' is acquired according to the formula of calculating the mobility of the driving transistor, i.e., $$K = \frac{1}{b\sqrt{V_{sense}}},$$

and then, a second threshold voltage Vthn'=Vthn+a*(Kn'−Kn) of the driving transistor is determined according to the first threshold voltage Vthn, the difference between the second mobility Kn' and the first mobility Kn, and the pre-acquired compensation factor a. The light-emitting current of the light-emitting element corresponding to the driving transistor may be acquired according to the adjustment voltage $V_n$, the second mobility Kn', the second threshold voltage Vthn' and the formula of calculating the light-emitting current of the light-emitting element, thereby realizing the compensation on the driving transistor.

Likewise, compensation may be continued to be performed on other driving transistors in the pixel units of the nth row and driving transistors in pixel units of other rows.

That is, when the compensation is performed on the driving transistors in the pixel units of each row, a threshold voltage change value (i.e., the external compensation value) of the driving transistor in the pixel unit of the previous row+the initial threshold voltage of the driving transistor in the pixel unit of the current row+the reference voltage is used as the adjustment voltage to be inputted to the data line, and the mobility of the driving transistor in the pixel unit of the current row is calculated and acquired according to the electrical signal outputted by the sensing line, which may reduce the error and improve the image sticking compensation effect.

A display apparatus is further provided in some embodiments of the present disclosure, including the device for compensating the display device described above. The display apparatus may be any product or component with a display function such as a television, a display, a digital photo frame, a mobile phone, a tablet computer. The display apparatus further includes a flexible circuit board, a printed circuit board and a backplane.

A device for compensating the display device is further provided in some embodiments of the present disclosure, including: a memory, a processor, and a computer program stored in the memory and executed by the processor, the processor is configured to execute the computer program to perform the method for compensating the display device described above.

A computer readable storage medium on which a computer program is stored is further provided in some embodiments of the present disclosure, the computer program is executed by a processor to perform the method for compensating the display device described above.

It should be appreciated that the embodiments described above may be implemented by hardware, software, firmware, middleware, microcodes, or a combination thereof. For hardware implementation, a processing unit may be implemented in one or more of Application Specific Integrated Circuits (ASICs), Digital Signal Processors (DSPs), Digital Signal Processing Devices (DSPDs), Programmable Logic Devices (PLDs), Field-Programmable Gate Arrays (FPGAs), a general-purpose processor, a controller, a microcontroller, a microprocessor, and other electronic units for performing the functions described in this application or combinations thereof.

For software implementation, techniques described above may be implemented via modules (such as processes, functions, etc.) that perform the functions described above. Software codes may be stored in a memory and executed by a processor. The memory may be implemented in the processor or external to the processor.

Various embodiments in the specification are described in a progressive manner, each embodiment focuses on differences from other embodiments, and same or similar parts among various embodiments may be acquired by referring to other embodiments.

Those skilled in the art should understand that some embodiments of the present disclosure may be provided as a method, a device, or a computer program product. Therefore, some embodiments of the present disclosure may be a form of a hardware embodiment, a software embodiment, or an embodiment combining software with hardware. Moreover, some embodiments of the present disclosure may be implemented in a form of a computer program product implemented on one or more computer usable storage media (including but not limited to a disk storage, a CD-ROM, an optical storage, etc.) containing a computer usable program code.

Some embodiments of the present disclosure are described with reference to flowcharts and/or block diagrams of a method, a user equipment (system) and a computer program product in some embodiments of the present disclosure. It should be appreciated that each process in the flowcharts and/or each block in the block diagrams, and a combination of a process in the flowcharts and/or a block in the block diagrams may be implemented by computer program instructions. The computer program instructions may be provided to a processor of a general purpose computer, a special purpose computer, an embedded processor, or other programmable data processing devices to produce a machine, such that the instructions executed by the processor of the computer or other programmable data processing devices produces a device for realizing functions specified in one or more processes in the flowcharts and/or one or more blocks in the block diagrams.

The computer program instructions may also be stored in a computer readable memory capable of directing a computer or other programmable data processing devices to operate in a particular manner, such that the instructions stored in the computer readable memory produce a manufacture including an instruction device, the instruction device implements functions specified in one or more processes in the flowcharts and/or one or more blocks in the block diagrams.

The computer program instructions may also be loaded onto the computer or other programmable data processing devices, so that a series of operating steps may be performed on the computer or other programmable devices to produce a computer-implemented processing, and thus instructions executed by the computer or other programmable devices provide steps for implementing the functions specified in one or more processes in the flowcharts and/or one or more blocks in the block diagrams.

Although some optional embodiments of the present disclosure have been described, those skilled in the art may make other replacements and modifications to these embodiments once they know basic inventive concepts. Therefore, the appended claims are intended to be construed to include the optional embodiments and all replacements and modifications that fall within the scope of the embodiments of the present disclosure.

It should be noted that in the present disclosure, terms describing relations such as first and second are used only to distinguish one entity or operation from another entity or operation, and do not necessarily require or imply that there is any such actual relationship or order between the entities or operations. Moreover, a term "include", "have" or any other variation thereof is intended to encompass non-exclusive inclusion, such that a process, a method, a product or a device including a series of elements includes not only those elements, but also other elements not explicitly listed, or elements inherent to the process, the method, the product or the device. Without more restrictions, an element defined by an expression "including a . . . " does not exclude existence of other identical or different elements in the process, the method, the product or the device including the element.

The aforementioned are merely optional embodiments of the present disclosure, any modifications and improvements that would easily occurred to those skilled in the art, without departing from the principles described in the present disclosure, should be encompassed in the protection scope of the present disclosure.

The invention claimed is:

1. A method for compensating a display device, wherein the display device comprises a plurality of rows of pixel units, at least one of the plurality of rows of pixel units comprises a pixel driving circuit and a light-emitting element coupled to the pixel driving circuit, the pixel driving circuit comprises a driving transistor and a sensing line for sensing an electrical signal of the light-emitting element, the method comprising:

acquiring a first mobility and a first threshold voltage of the driving transistor, wherein the first mobility and the first threshold voltage are acquired when the display device is not displaying;

acquiring a second mobility of the driving transistor according to the electrical signal on the sensing line, wherein the second mobility is acquired when the display device is displaying;

determining a second threshold voltage of the driving transistor according to the first threshold voltage, a difference between the second mobility and the first mobility, and a pre-acquired compensation factor; and calculating an external compensation value of a display data signal according to the second threshold voltage and the second mobility, superimposing the external compensation value and the display data signal, and inputting a superimposed display data signal to the pixel driving circuit for driving the light-emitting element to emit light, wherein the acquiring the second mobility of the driving transistor according to the electrical signal on the sensing line comprises:

inputting an adjustment voltage to a data line of the pixel driving circuit, wherein the adjustment voltage is a sum of a reference voltage and the first threshold voltage of the driving transistor, the reference voltage is a fixed value; and calculating the second mobility according to the electrical signal on the sensing line of the pixel driving circuit;

wherein the external compensation value is determined according to a second threshold voltage and a second mobility of a driving transistor in a pixel unit of a (n−1)th row, $$\text{the external compensation value}=\text{the second threshold voltage}-\text{the first threshold voltage}=a*(\text{the second mobility}-\text{the first mobility})=a*(K'(n-1)-K(n-1))=a*\Delta K(n-1),$$

wherein, ΔK(n−1) is a difference between the second mobility K'(n−1) and the first mobility K(n−1) of the driving transistor in the pixel unit of the (n−1)th row, n is an integer larger than 1, a is the compensation factor;

the superimposed display data signal is an adjustment voltage on a data line of a pixel driving circuit in a pixel unit of an nth row, and the superimposing the external compensation value and the original display data signal comprises:

determining the adjustment voltage on the data line of the pixel driving circuit in the pixel unit of the nth row according to the following formula:

$$\text{the adjustment voltage}=\text{a reference voltage}+\text{the first threshold voltage}+\text{the external compensation value},$$

wherein, the reference voltage is a fixed value.

2. The method for compensating the display device according to claim 1, prior to the determining the second threshold voltage of the driving transistor according to the first threshold voltage, the difference between the second mobility and the first mobility, and the pre-acquired compensation factor, further comprising a step of acquiring the compensation factor, and the step of acquiring the compensation factor comprises:

acquiring a first curve of the mobility of the driving transistor with temperature, and calculating a mobility temperature change slope of the driving transistor according to the first curve;

acquiring a second curve of the threshold voltage of the driving transistor with temperature, and calculating a threshold voltage temperature change slope of the driving transistor according to the second curve; and acquiring the compensation factor a according to the mobility temperature change slope and the threshold voltage temperature change slope.

3. The method for compensating the display device according to claim 2, wherein the acquiring the compensation factor a according to the mobility temperature change slope and the threshold voltage temperature change slope comprises:

determining the compensation factor a according to the following formula:

$a$=the threshold voltage temperature change slope/the mobility temperature change slope.

4. The method for compensating the display device according to claim 1, wherein the determining the second threshold voltage of the driving transistor according to the first threshold voltage, the difference between the second mobility and the first mobility, and the pre-acquired compensation factor comprises:

determining the second threshold voltage of the driving transistor according to the following formula:

the second threshold voltage=the first threshold voltage+$a$*(the second mobility−the first mobility), wherein, a is the compensation factor.

5. The method for compensating the display device according to claim 4, wherein the determining the second threshold voltage of the driving transistor according to the first threshold voltage, the difference between the second mobility and the first mobility, and the pre-acquired compensation factor comprises:

determining the second threshold voltage of the driving transistor according to the following formula:

the second threshold voltage=the first threshold voltage+$a$*(the second mobility−the first mobility), wherein, a is the compensation factor.

6. A device for compensating a display device, the display device comprises a plurality of rows of pixel units, at least one of the plurality of rows of pixel units comprises a pixel driving circuit and a light-emitting element coupled to the pixel driving circuit, the pixel driving circuit comprises a driving transistor and a sensing line for sensing an electrical signal of the light-emitting element, the device for compensating the display device comprising:

a measurement sub-circuit, configured to acquire a first mobility and a first threshold voltage of the driving transistor, wherein the first mobility and the first threshold voltage are acquired when the display device is not displaying;

an acquisition sub-circuit, configured to acquire a second mobility of the driving transistor according to the electrical signal on the sensing line, wherein the second mobility is acquired when the display device is displaying;

a processing sub-circuit, configured to determine a second threshold voltage of the driving transistor according to the first threshold voltage, a difference between the second mobility and the first mobility, and a pre-acquired compensation factor; and a compensation sub-circuit, configured to calculate an external compensation value of a display data signal according to the second threshold voltage and the second mobility, superimpose the external compensation value and the display data signal, and input a superimposed display data signal to the pixel driving circuit for driving the light-emitting element to emit light, wherein the acquisition sub-circuit is further configured to:

input an adjustment voltage to a data line of the pixel driving circuit, wherein the adjustment voltage is a sum of a reference voltage and the first threshold voltage of the driving transistor, the reference voltage is a fixed value; and calculate the second mobility according to the electrical signal on the sensing line of the pixel driving circuit;

wherein the compensation sub-circuit is further configured to calculate an external compensation value of a display data signal of a pixel driving circuit in a pixel unit of an nth row according to a second threshold voltage and a second mobility of a driving transistor in a pixel unit of a (n−1)th row, the external compensation value=the second threshold voltage−the first threshold voltage=$a$*(the second mobility−the first mobility)=$a$*($K'(n-1)-K(n-1)$)=$a$*$\Delta K(n-1)$, wherein, ΔK(n−1) is a difference between the second mobility K'(n−1) and the first mobility K(n−1) of the driving transistor in the pixel unit of the (n−1)th row, n is an integer larger than 1, a is the compensation factor;

the superimposed display data signal is an adjustment voltage on a data line of a pixel driving circuit in a pixel unit of the nth row, and the compensation sub-circuit is further configured to determine the adjustment voltage on the data line of the pixel driving circuit in the pixel unit of the nth row according to the following formula:

the adjustment voltage=a reference voltage+the first threshold voltage+the external compensation value, wherein, the reference voltage is a fixed value.

7. The device for compensating the display device according to claim 6, further comprising a compensation factor acquisition sub-circuit, the compensation factor acquisition sub-circuit comprises:

a first curve acquisition unit, configured to acquire a first curve of the mobility of the driving transistor with temperature, and calculate a mobility temperature change slope of the driving transistor according to the first curve;

a second curve acquisition unit, configured to acquire a second curve of the threshold voltage of the driving transistor with temperature, and calculate a threshold voltage temperature change slope of the driving transistor according to the second curve; and a calculation unit, configured to acquire the compensation factor a according to the mobility temperature change slope and the threshold voltage temperature change slope.

8. The device for compensating the display device according to claim 7, wherein the calculation unit is further configured to determine the compensation factor a according to the following formula:

$a$=the threshold voltage temperature change slope/the mobility temperature change slope.

9. The device for compensating the display device according to claim 6, wherein the processing sub-circuit is further configured to determine the second threshold voltage of the driving transistor according to the following formula:

the second threshold voltage=the first threshold voltage+$a$*(the second mobility−the first mobility), wherein a is the compensation factor.

10. The device for compensating the display device according to claim 9, wherein the processing sub-circuit is further configured to determine the second threshold voltage of the driving transistor according to the following formula:

the second threshold voltage=the first threshold voltage+$a$*(the second mobility−the first mobility), wherein a is the compensation factor.

11. A display apparatus, comprising the device for compensating the display device according to claim 6.

12. A device for compensating the display device, comprising: a memory, a processor, and a computer program stored in the memory and executed by the processor, the processor is configured to execute the computer program to perform the method for compensating the display device according to claim 1.

13. A computer readable medium on which a computer program is stored, the computer program is executed by a processor to perform the method for compensating the display device according to claim 1.

* * * * *